US006585174B1

(12) United States Patent
Huang

(10) Patent No.: US 6,585,174 B1
(45) Date of Patent: Jul. 1, 2003

(54) MANUAL FLOW CONTROL STRUCTURE OF A LAWN SPRINKLER NOZZLE

(76) Inventor: Dustin Huang, No. 2, Yung-Feng Lane, Hsin-Pao Village, Fang-Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/115,710

(22) Filed: Apr. 5, 2002

(51) Int. Cl.[7] ..... B05B 1/30; B05B 9/08; B05B 15/06; B05B 15/08

(52) U.S. Cl. ..... 239/581.1; 239/530; 239/532; 239/587.4

(58) Field of Search ..... 239/530, 525, 239/532, 587.1, 587.4, 588, 581.1

(56) References Cited

U.S. PATENT DOCUMENTS

| | | | | | |
|---|---|---|---|---|---|
| 2,144,619 | A | * | 1/1939 | Corley | 239/581.1 |
| 2,289,889 | A | * | 7/1942 | Stick et al. | 239/273 |
| 2,753,219 | A | * | 7/1956 | Matarese | 239/456 |
| 3,083,725 | A | * | 4/1963 | Moen | 137/454.2 |
| 3,412,941 | A | * | 11/1968 | Steinback | 239/581.1 |
| 5,031,839 | A | * | 7/1991 | Waldrum | 239/331 |
| 6,216,965 | B1 | * | 4/2001 | Chao | 239/587.4 |
| 6,220,527 | B1 | * | 4/2001 | Chen et al. | 239/532 |
| 6,254,017 | B1 | * | 7/2001 | Kuo | 239/532 |
| 6,471,147 | B1 | * | 10/2002 | Kuo | 239/600 |

OTHER PUBLICATIONS

Huang, Dustin; U.S. patent application No. 10/120,434: Claim 1.*

* cited by examiner

*Primary Examiner*—Michael Mar
*Assistant Examiner*—Darren Gorman
(74) *Attorney, Agent, or Firm*—Harrison & Egbert

(57) ABSTRACT

A lawn sprinkler nozzle includes a nozzle head, a hollow connection pipe, and a hollow handle. The connection pipe is connected between the nozzle head and the handle. The handle is provided at one end with a flow control structure which is formed of a cylindrical body, a ball valve, and a control knob. The cylindrical body is detachably fastened to the connection pipe. The ball valve is rotatably disposed in the interior of the cylindrical body such that the ball valve is actuated by the control knob to turn so as to control the flow of water from the handle to the nozzle head.

1 Claim, 10 Drawing Sheets

MANUAL FLOW CONTROL STRUCTURE OF A LAWN SPRINKLER NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lawn sprinkler, and more particularly to a manually-operated structure for controlling water flow of the lawn sprinkler.

BACKGROUND OF THE INVENTION

As shown in FIGS. 1 and 2, the prior art sprinkler nozzles are provided in the handle with a control lever for regulating the water flow. In operation, the control lever must be constantly maneuvered with finger of a user of the sprinkler nozzles. It is conceivably tiresome and inconvenient to press or rotate the control levers for a prolonged period of time.

BRIEF SUMMARY OF THE INVENTION

The primary objective of the present invention is to provide a lawn sprinkler nozzle with a manually-operated structure for controlling the water flow of the lawn sprinkler nozzle. The water flow control structure is located between the nozzle and the handle and is formed of hollow cylindrical body, a ball valve, and a control knob. The hollow cylindrical body is extended from one end of the handle. The ball valve is rotatably located in the interior of the cylindrical body such that the ball valve is linked with the control knob. As the control knob is turned with thumb the ball valve is actuated to turn to allow the water to flow through the water hole of the ball valve.

The features and the advantages of the present invention will be more readily understood upon a thoughtful deliberation of the following detailed description of the present invention with reference to the accompanying drawings.

DETAILED DESCRIPTION OF THE INVENTION

Figure 1:
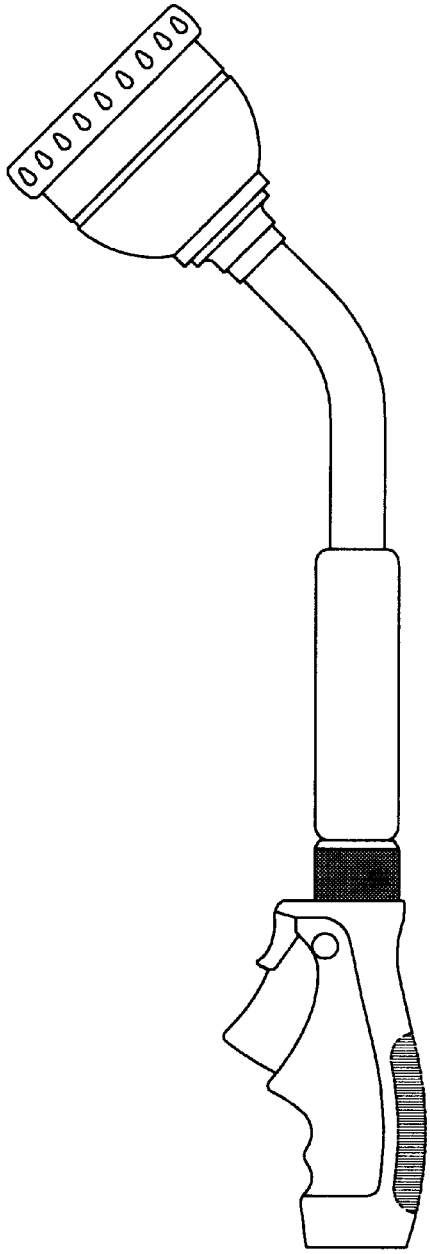
FIG.1 PRIOR ART
FIGS. 1 and 2 are schematic views of the prior art lawn sprinkler nozzles.
Figure 2:
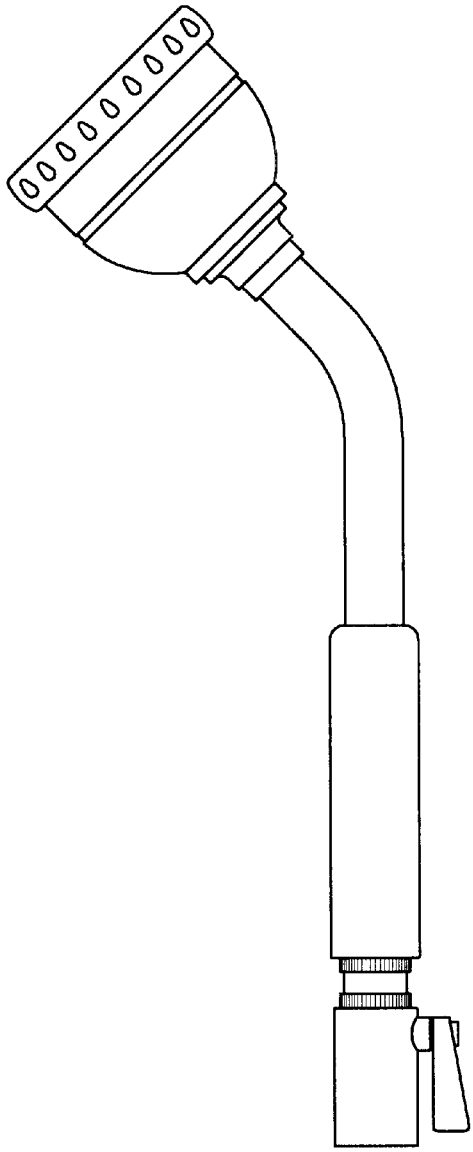
FIG. 2 PRIOR ART
Figure 3:
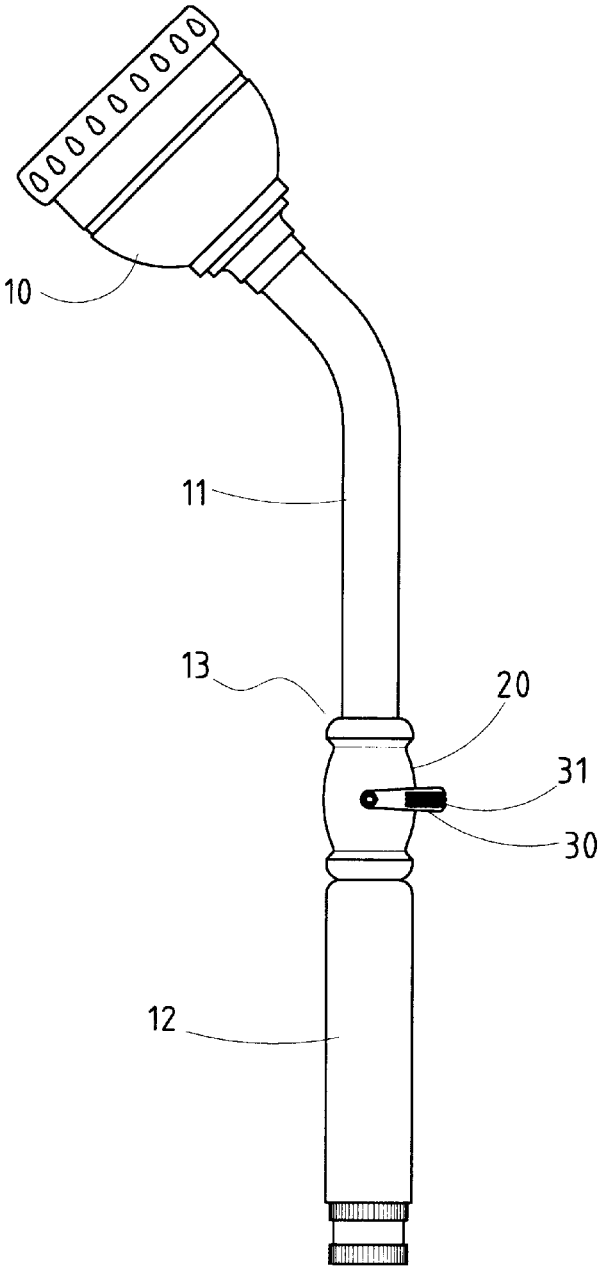
FIG. 3 shows a perspective view of a lawn sprinkler nozzle of the present invention.
Figure 4:
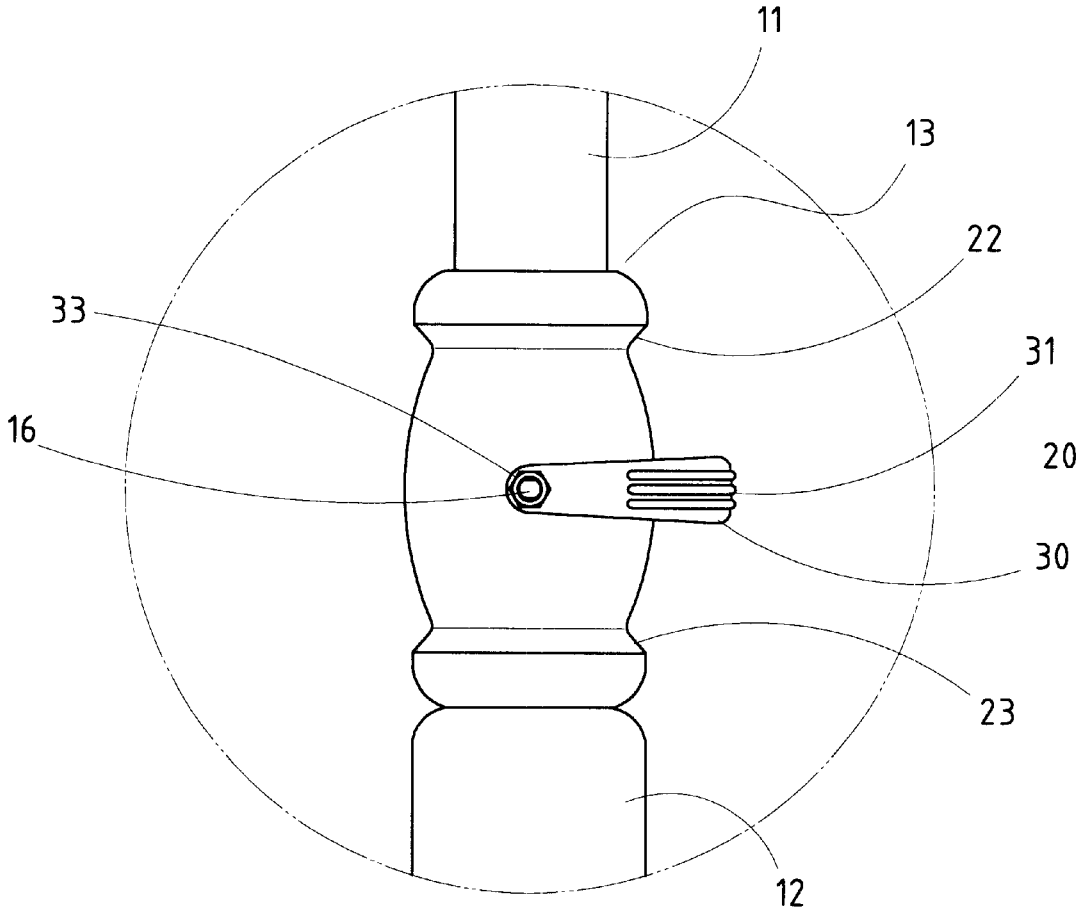
FIG. 4 shows an external schematic view of a flow control structure of the lawn sprinkler nozzle of the present invention.
Figure 5:
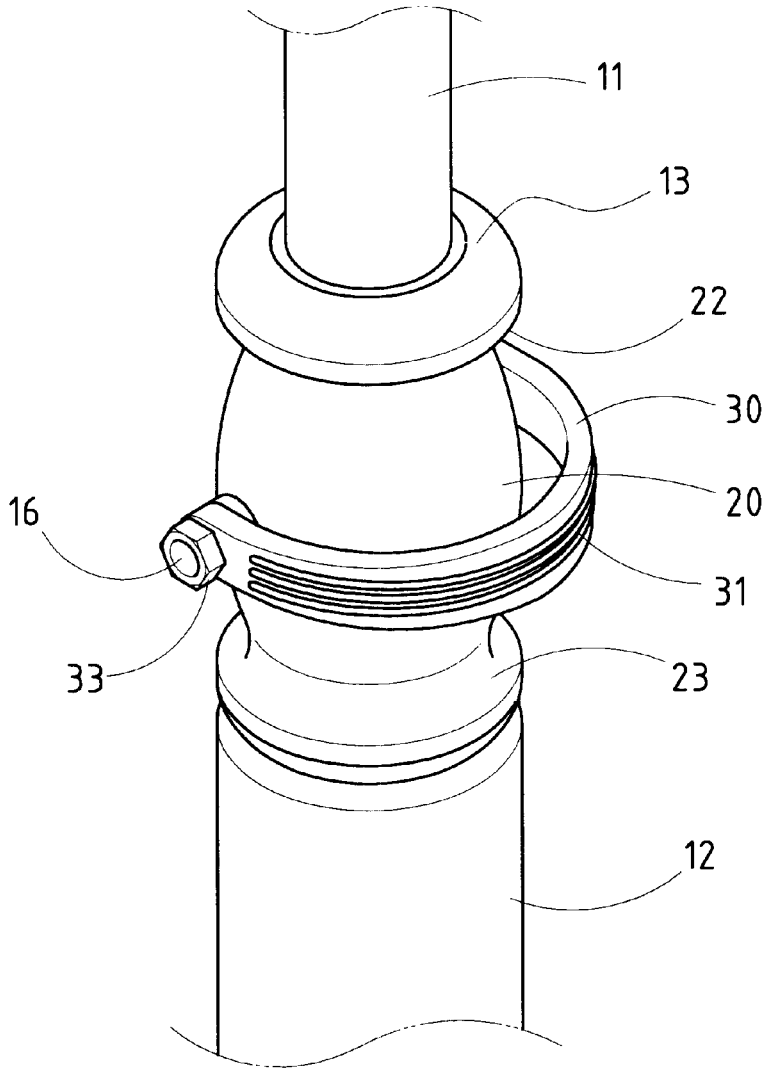
FIG. 5 shows another external schematic view of the flow control structure of the lawn sprinkler nozzle of the present invention.
Figure 6:
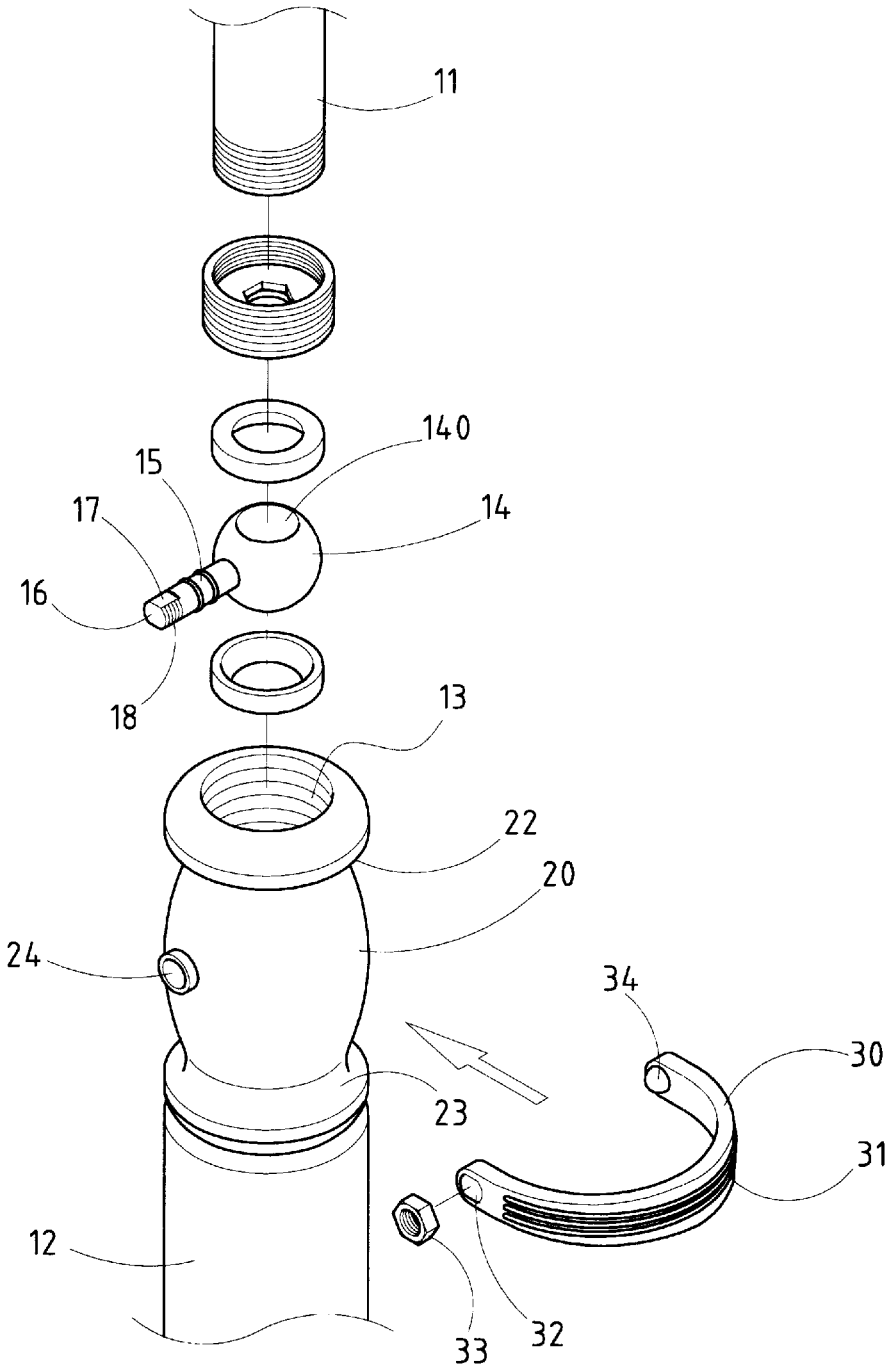
FIG. 6 shows an exploded perspective view of the flow control structure of the present invention.

As shown in FIGS. 3–10, a lawn sprinkler nozzle of the present invention comprises a nozzle head 10, a connection pipe 11 fastened at one end to the nozzle head 10, and a handle 12 fastened at one end to another end of the connection pipe 11. The handle 12 is fastened at the other end to a hose (not shown in the drawings). Both the connection pipe 11 and the handle 12 have a hollow interior through which water flows from the hose into the: nozzle head 10.

The present invention is characterized by the handle 12 which is provided at one end with a flow control structure comprising a hollow cylindrical body 20, a ball valve 14, and a control knob 30.

The hollow cylindrical body 20 is extended from the one end of the handle 12 and is provided in the outer wall of an upper end with an upper flange 22, and in the outer wall of a lower end with a lower flange 23 contiguous to the one end of the handle 12. The cylindrical body 20 is provided at the upper end with a female threaded portion 13 by means of which the hollow cylindrical body 20 is detachably fastened with the other end of the connection pipe 11. In other words, the cylindrical body 20 is engageable with a variety of nozzle heads 10. The hollow interior of the cylindrical body 20 is provided in the upper end with a water outlet 42 in communication with the hollow interior of the connection pipe 11, and in the lower end with a water inlet 41 in communication with the hollow interior of the handle 12. The cylindrical body 20 is provided in the side wall with a through hole 24 in communication with the hollow interior of the cylindrical body 20. The cylindrical body 20 is further provided in the outer side wall with a socket 21 opposite in location to the through hole 24. The side wall of the cylindrical body 20 has an arcuate outer surface with a radian greater than 90 degrees.

The ball valve 14 is provided with a water hole 140, and a connection rod 15 fastened therewith. The ball valve 14 is rotatably located in the hollow interior of the cylindrical body 20 such that the connection rod 15 of the ball valve 14 is jutted out of the cylindrical body 20 via the through hole 24 of the cylindrical body 20. The connection rod 15 is provided at a free end 16 with a planar surface 17 and an outer threaded portion 18.

Figure 7:
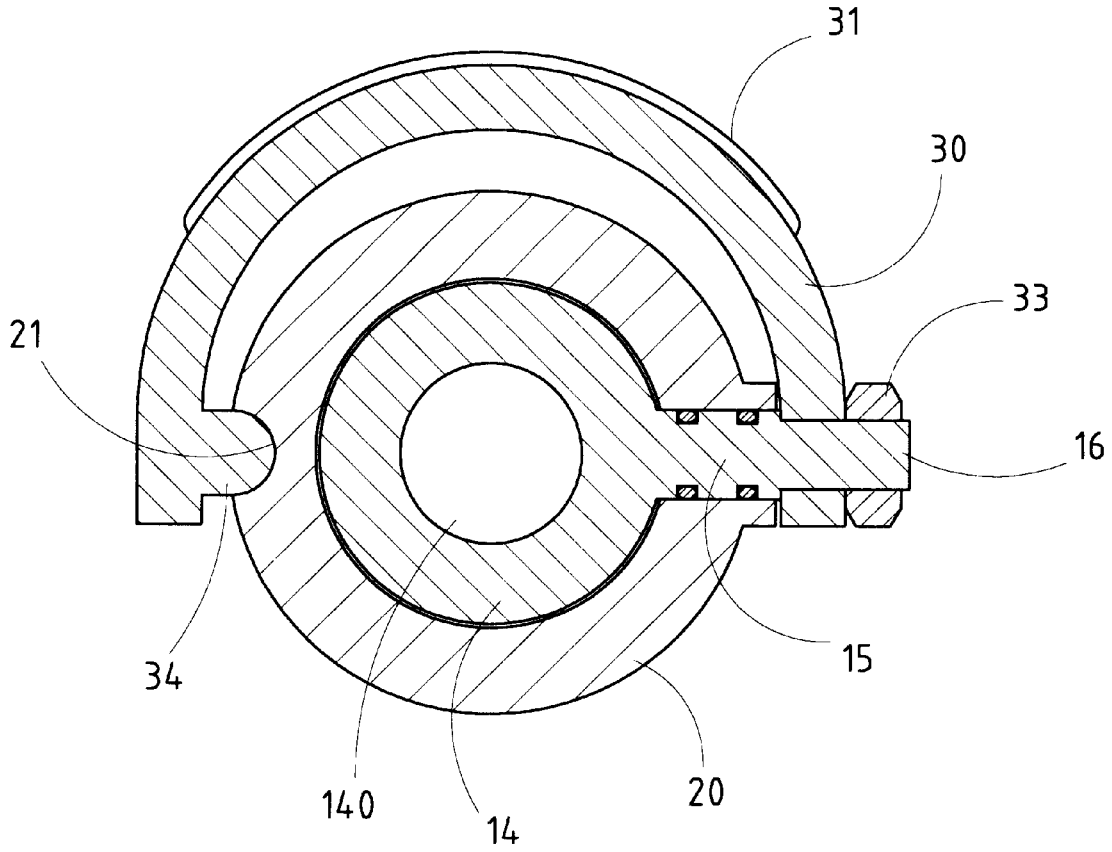
FIG. 7 shows a cross-sectional view of the flow control structure of the present invention.
Figure 8:
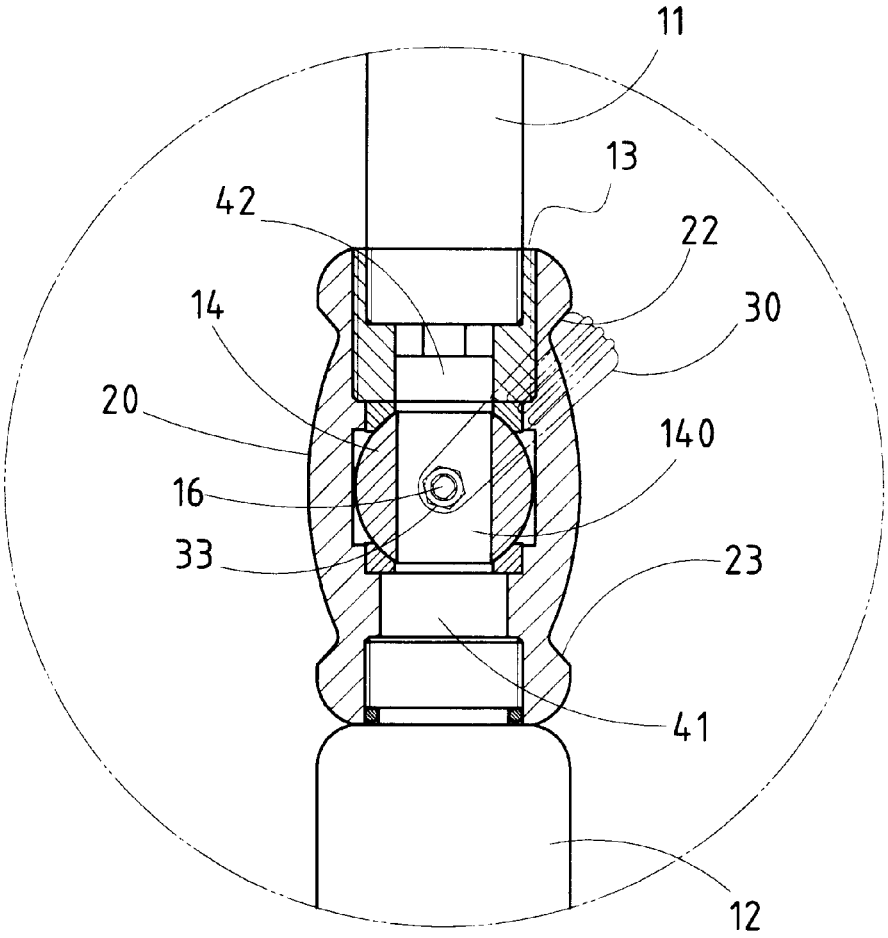
FIG. 8 shows a longitudinal sectional view of the flow control structure of the present invention in action.
Figure 9:
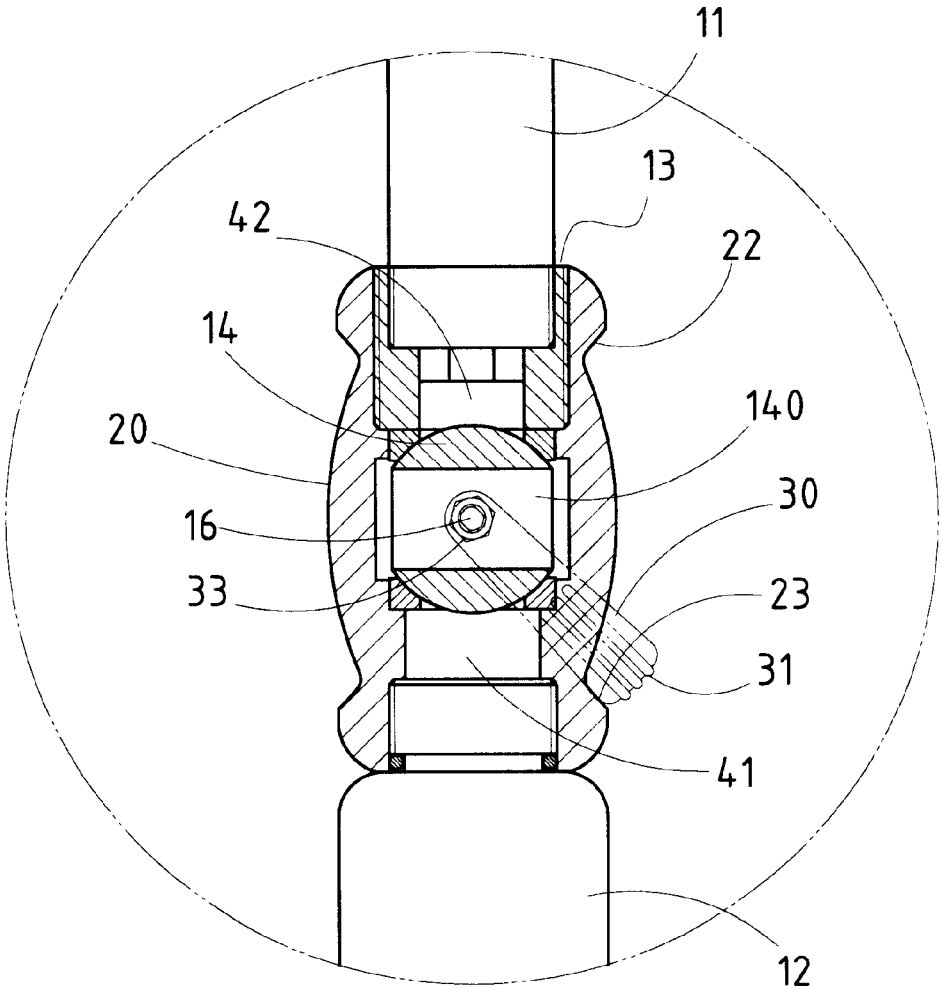
FIG. 9 shows another longitudinal sectional view of the flow control structure of the present invention in action.
Figure 10:
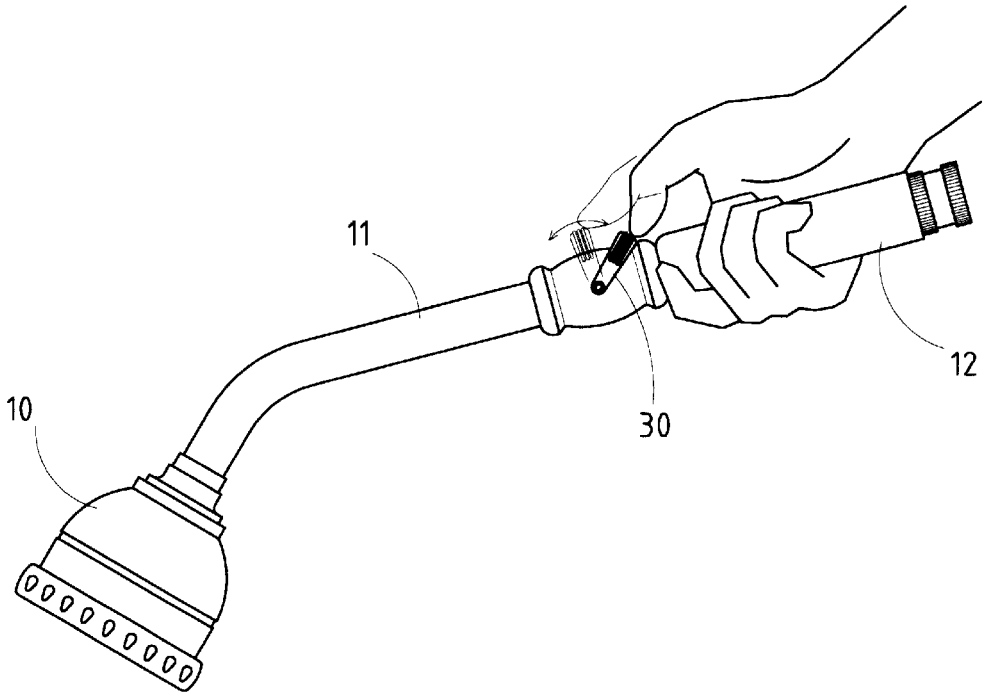
FIG. 10 shows a schematic view of the manual operation of the present invention.

The control knob 30 has an arcuate shape corresponding in radian to the arcuate outer surface of the cylindrical body 20. The control knob 30 is provided at one end with a fastening hole 32, and at other end with a spherical projection 34 corresponding in location to the socket 21 of the cylindrical body 20. The control knob 30 is rotatably fastened to the outer side wall of the cylindrical body 20 such that the one end of the control knob 30 is fastened with the connection rod 15 of the ball valve 14 in conjunction with a nut 33 which is engaged with the outer threaded portion 18 of the connection rod 15. The free end 16 of the connection rod 15 is put through the fastening hole 32 of the control knob 30. The spherical projection 34 of the other end of the control knob 30 is rotatably received in the socket 21 of the cylindrical body 20, as shown in FIG. 7. The control knob 30 can be turned with thumb of one hand which holds the handle 12, as illustrated in FIG. 10. The ball valve 14 is actuated to turn by the control knob 30 via the connection rod 15 such that the water hole 140 is in communication with the water inlet 41 and the water outlet 42 of the cylindrical body 20, as shown in FIG. 8. As a result, the water supply is made available to the nozzle head 10. As shown in FIG. 8, when the control knob 30 is turned in one direction such that the control knob 30 is stopped by the upper flange 22 of the cylindrical body 20, the water hole 140 of the ball valve 14 is aligned with the water inlet 41 and the water outlet 42 of the hollow interior of the cylindrical body 20. On the other hand, when the control knob 30 is turned in other direction such that the control knob 30 is stopped by the lower flange 23 of the cylindrical body 20, as shown in FIG. 9, the water hole 140 of the ball valve 14 is no longer aligned with the water inlet 41 and the water outlet 42 of the hollow interior of the cylindrical body 20, thereby resulting in stoppage of water supply to the nozzle head 10.

The control knob 30 is provided in the outer side with a skidproof structure 31.

I claim:

1. A lawn sprinkler nozzle comprising:

a nozzle head;

a connection pipe fastened at one end to said nozzle head and comprising a hollow interior in communication with said nozzle head; and a handle comprised of a hollow interior, and, at one end, a flow control structure by which said handle is fastened at the one end to another end of said connection pipe such that the hollow interior of said handle is in communication with the hollow interior of said connection pipe, said handle being engageable at another end thereof with a hose;

wherein said flow control structure comprises:

a cylindrical body extending from the one end of said handle and comprising a hollow interior which is provided at an upper end with a water outlet and at a lower end with a water inlet, said water outlet being in communication with the hollow interior of said connection pipe, said water inlet being in communication with the hollow interior of said handle, said cylindrical body being provided in the outer wall of an upper end with an upper flange, and in the outer wall of a lower end with a lower flange, said cylindrical body further provided in the outer surface of a side wall with a socket, and in the side wall with a through hole in communication with the hollow interior of said cylindrical body and opposite in location to said socket, said cylindrical body being detachably fastened at the upper end to the other end of said connection pipe whereby the side wall of said cylindrical body has an arcuate outer surface with a radian greater than 90 degrees;

a ball valve comprised of a water hole, and a connection rod fastened thereto, said ball valve being rotatably disposed in the hollow interior of said cylindrical body such that a free end of said connection rod juts out of said cylindrical body via said through hole of said cylindrical body; and a control knob arcuate in shape and corresponding in radian to said arcuate outer surface of the side wall of said cylindrical body, said control knob being comprised of, at one end, a fastening hole and at another end, a spherical projection, said control knob being rotatably fastened to the outer side wall of said cylindrical body such that said fastening hole of the one end of said control knob is fastened to said free end of said connection rod of said ball valve, and that said spherical projection of the other end of said control knob is rotatably received in said socket of said cylindrical body whereby said control knob is turned in one direction until said control knob is stopped by said upper flange of said cylindrical body, thereby resulting in alignment of said water hole of said ball valve with said water inlet and said water outlet of said cylindrical body, said water hole of said ball valve being nonaligned with said water inlet and said water outlet of said cylindrical body at such time when said control knob is turned in another direction until said control knob is stopped by said lower flange of said cylindrical body.

* * * * *